US007604211B2

(12) United States Patent
Moore

(10) Patent No.: US 7,604,211 B2
(45) Date of Patent: Oct. 20, 2009

(54) SPILL-RESISTANT CARRYING APPARATUS

(76) Inventor: Kevin S. Moore, 2340 Nielsen Ct., El Cajon, CA (US) 92020

( * ) Notice: Subject to any disclaimer, the term of this patent is extended or adjusted under 35 U.S.C. 154(b) by 0 days.

(21) Appl. No.: 11/839,442

(22) Filed: Aug. 15, 2007

(65) Prior Publication Data

US 2008/0042021 A1 Feb. 21, 2008

Related U.S. Application Data

(60) Provisional application No. 60/838,678, filed on Aug. 18, 2006.

(51) Int. Cl.
*A47F 7/00* (2006.01)

(52) U.S. Cl. ..... 248/309.1; 248/346.03; 220/737

(58) Field of Classification Search ..... 248/544, 248/309.1, 346.03, 311.2; 108/44; 224/148.4, 224/148.7, 311.3, 312, 312.1, 151; 211/74; 220/737, 752
See application file for complete search history.

(56) References Cited

U.S. PATENT DOCUMENTS 1,877,217 A * 9/1932 Anderson ..... 312/289
4,798,360 A * 1/1989 Alter ..... 248/311.2
D351,103 S * 10/1994 Reynolds ..... D9/456
6,390,705 B1 5/2002 Dailey
6,761,287 B2 * 7/2004 Caruso ..... 222/154
6,778,813 B1 * 8/2004 Lilly ..... 455/90.3
6,779,915 B2 * 8/2004 Foster, Jr. ..... 366/129
6,905,038 B2 * 6/2005 Lopez ..... 215/228
7,055,709 B1 * 6/2006 Esau ..... 215/228
7,128,299 B1 * 10/2006 Klotz ..... 248/346.11
2006/0144845 A1 * 7/2006 Tavano ..... 220/737

* cited by examiner

*Primary Examiner*—J. Allen Shriver
*Assistant Examiner*—Steven Marsh
(74) *Attorney, Agent, or Firm*—Crowell & Moring LLP

(57) ABSTRACT

A spill-resistant carrying apparatus includes a platform having a top surface and a bottom surface supported on legs. The platform includes one or more cavities which each have a set of female threads disposed into the bottom surface, and a set of male threads disposed into and extending from the top surface. In one embodiment, the male threads are oriented substantially adjacent to the female threads. The platform may further be configured with a lip disposed along a periphery of the platform and extending to a height greater than a height of the top surface.

16 Claims, 4 Drawing Sheets

SPILL-RESISTANT CARRYING APPARATUS

CROSS REFERENCE TO RELATED APPLICATION

This application claims the benefit of U.S. Provisional Application No. 60/838,678, filed Aug. 18, 2006.

FIELD OF THE INVENTION

The present invention relates to a novel spill-resistant carrying apparatus, and more particularly to a container carrying unit which functions as a stand and incorporates a spill-resistant design.

BACKGROUND OF THE INVENTION

In the plumbing and electrician industries, for example, polyvinyl chloride (PVC) pipe is a commonly used material. Its flexibility, durability and low cost make PVC pipe an ideal material for use in many plumbing and electrician applications. Additionally, handy-men and landscapers routinely use PVC pipe in their trades as well. PVC is also commonly used as an insulating conduit for electric wires. While other types of plastic pipe usable in these contexts have included chlorinated polyvinyl chloride (CPVC), polyethylene and acrylonitrile butadiene styrene (ABS) pipe, PVC is still the most ubiquitously used piping material.

Perhaps the main drawback of using plastic pipe is that a two-step process is required to effectively join two pieces of plastic pipe and/or plastic fittings. This two-step process begins with the application of a primer to the surface of a first piece of plastic pipe. The primer serves to "soften" the pipe's surface making it more receptive to the formation of an adhesive bond. Once primed, a cement or other adhesive may then be applied to the pipe's surface. This first piece of pipe may then be joined to a second piece, typically by way of a plastic fitting, by inserting a male end into a female end. This two-step process is often carried out on both the male and female ends of the piping material to the joining step.

As is commonly known in the field, the aforementioned pipe preparation process tends to lead to unnecessary clutter due to the need to carry around two separate containers—one for the primer and one for the cement. When working in confined areas, as is typically required in the plumbing industry, efficiency of space is at a premium. Moreover, working with separate containers of primer and cement in confined areas tends to cause excess spillage. The only solution known to exist heretofore is the use of duck tape to secure the two containers together in a very makeshift fashion. While this approach may reduce the amount of clutter somewhat, it fails to address the spillage issue. As such, there is a need in the art for a spill-resistant carrying apparatus for containers which overcomes one or more of the aforementioned drawbacks.

SUMMARY OF THE INVENTION

Disclosed and claimed herein is a spill-resistant carrying apparatus. In one embodiment, the apparatus comprises a substantially planar surface having a top surface and a bottom surface, wherein the substantially planar surface is supported by a plurality of legs at a first height. The apparatus further includes a lip disposed along a circumference of the top surface and extending to a second height that is greater than the first height, and a first and second cavity disposed along the substantially planar top surface. In one embodiment, the first and second cavities each include a set of internal threads extending into the bottom surface and configured to receive a threaded container opening, as well as a set of external threads extending into the top surface, adjacent to the set of internal threads, and configured to receive a threaded lid.

Other aspects, features, and techniques of the invention will be apparent to one skilled in the relevant art in view of the following description of the exemplary embodiments of the invention.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE EXEMPLARY EMBODIMENTS

One aspect of the invention is to provide an apparatus for integrating two or more containers into a convenient carrying unit. In one embodiment, no modification to the containers are required. The carrying unit may further function as a stand for the containers, and may optionally incorporate a spill-resistant design, as disclosed and described below.

The invention has particular applicability to the plumbing industry, although it may be equally applicable to numerous other industries such as electrician, handy-men and landscaper industries. One application of the invention is to provide an apparatus which combines the commonly-used PVC primer and PVC cement into a single integrated carrying unit, which optionally functions to limit excess spillage.

The following disclosure assumes that the containers to be integrated have been designed with a threaded cap of some sort, as is typically the case with PVC primer and PVC cement products. Such threaded caps are typically designed in accordance with the National pipe thread (NPT) U.S. standard for tapered threads, the details of which are beyond this disclosure. While PVC primer and cement products are currently manufactured accordingly to universal thread sizes, the present disclosure is not specific to any particular thread standard, and is equally applicable to any threaded cap or lid design.

Figure 1:
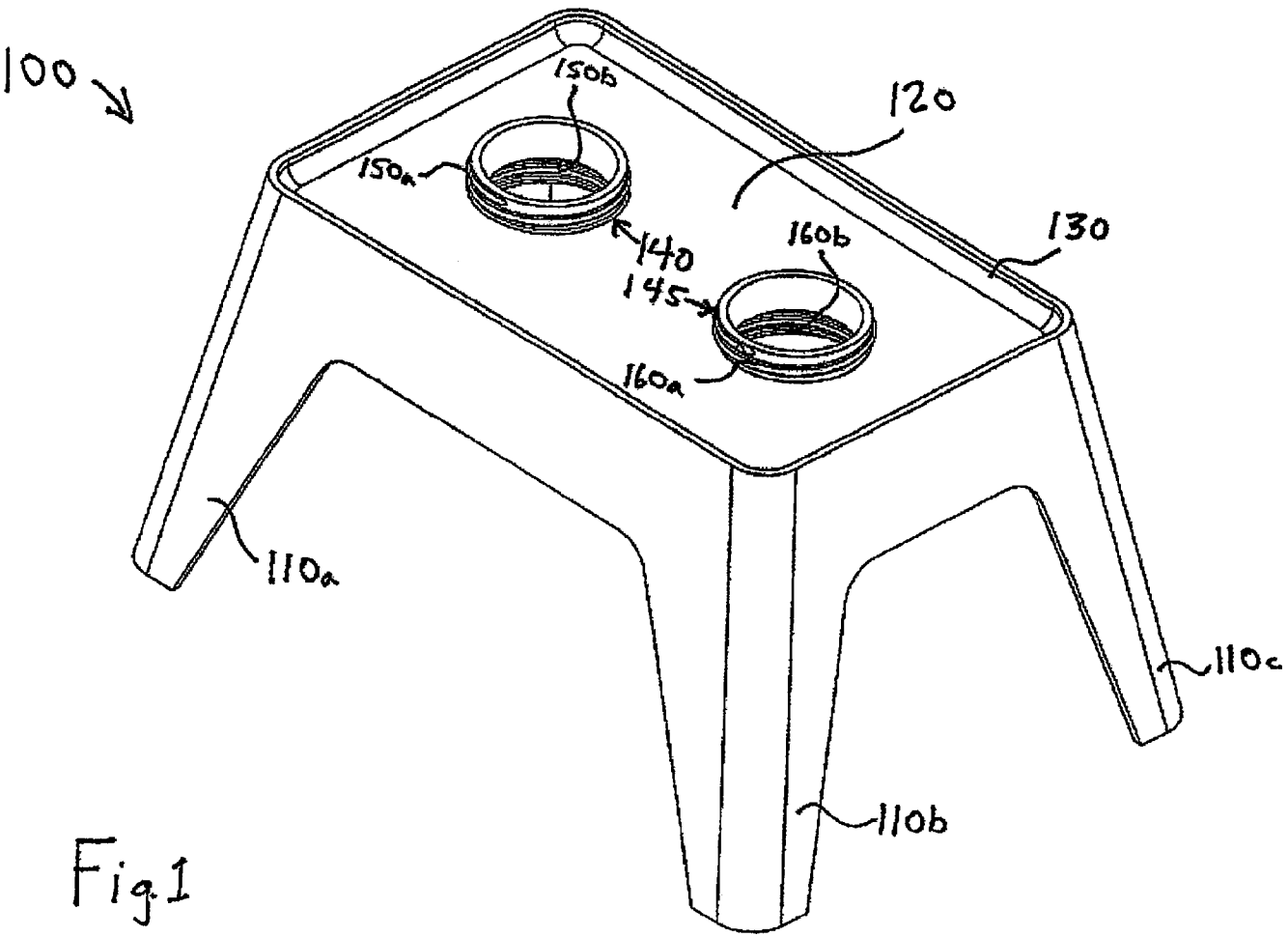
FIG. 1 is a perspective view of one embodiment of the invention.

Referring now to the figures, FIG. 1 is a perspective view of a container carrying apparatus 100 designed in accordance with one embodiment of the invention. While the apparatus itself may be manufactured from a hard plastic material, it may equally be fabricated from any other rigid material capable of supporting the weight of one or more containers. It should further be understood that the physical dimensions of the apparatus 100 may vary based on, for example, the size of the containers to be coupled thereto and/or operating-space-imposed constraints. For example, PVC primer and cement products are typically sold in standard sizes for both residential uses and commercial uses.

As shown, apparatus 100 includes two or more legs 110*a*-110*d* so as to function as a stand for the containers to be integrated thereto. While a fourth leg 100*d* is not visible in FIG. 1, the depicted embodiment of the apparatus 100 is a four-legged design. It should of course be appreciated that more or fewer legs may similarly be used in accordance with the principles of the invention.

Continuing to refer to FIG. 1, apparatus 100 is further comprised of a top surface 120 surrounded by a lip 130. In one embodiment, the top surface 120 is substantially planar and parallel to the plane on which the legs 110*a*-110*d* sit. As will be described in more detail below, lip 130 functions to limit the amount of spillage which may occur. While in one embodiment the lip is approximately ¼ inch in vertical height, it may be higher or lower depending on the amount of spillage to be contained.

The apparatus 100 of FIG. 1 is further depicted as including cavities 140 and 145. In one embodiment, these cavities 140 and 145 may each function to receive a corresponding container. By way of a non-limiting example, one of the cavities 140 and 145 may be configured to receive a container of PVC primer, while the other may be configured to receive a container of PVC cement. It should of course be appreciated that any other type of container may similarly be received into cavities 140 and 145. Moreover, it should be appreciated that apparatus 100 may include more than two cavities.

In the embodiment of FIG. 1, each of the depicted cavities 140 and 145 includes two sets of threads. In particular, threads 150*a* and 160*a* are male/external threads, while threads 150*b* and 160*b* are female/internal threads. In one embodiment, the internal threads 150*b* and 160*b* are designed to accommodate matching external threads on the opening of a container (e.g., can of PVC primer, can of PVC cement, etc.), while the external threads 150*a* and 160*a* may be designed to accommodate matching internal threads of a cap of the aforementioned container. In other words, the internal threads 150*b* and 160*b* of the apparatus may have an inside diameter which corresponds to the outside diameter of the external threads 150*a* and 160*a*. Moreover, the vertical height of the external threads 150*a* and 160*a* may be approximately equal to that of the lip 130, or may be alternatively higher or lower than the lip 130.

In this fashion, one or more containers, by way of the cavities 140 and 145, may be coupled to the apparatus 100 by screwing the threaded openings of the containers into the internal threads 150*b* and 160*b*. The container openings may then be sealed by screwing the container's own lid (or another lid) onto the external threads 150*a* and 160*a*. In this fashion, the containers may be integrated into a single unit without any modifications being made to the containers or their caps. It is particularly preferable to avoid modifications to the cap in the PVC primer and cement context since those caps are often designed with an integrated swab.

As previously mentioned, the apparatus may further include lip 130 which is designed to limit spillage. In the case where a container has been coupled to the apparatus 100 via internal threads 150*b* or 160*b*, any liquid contained in such container is susceptible of being spilled. By having a lip 130 extending around the periphery of the top surface 120, most spills can be contained. For plumbers, electricians, handymen and landscapers this means that PVC primer and cement spillages will be significantly reduced.

In addition to spillage containment, the apparatus 100 may enable otherwise spilled liquids to remain useful, thereby reducing costs associated with such spillages. For example, spilled PVC primer which is contained on the top surface by lip 130 will remain usable since no contamination has occurred. That is, primer and/or cement may be swabbed from the top surface 130 for application to plastic pipe just the same.

Figure 2:
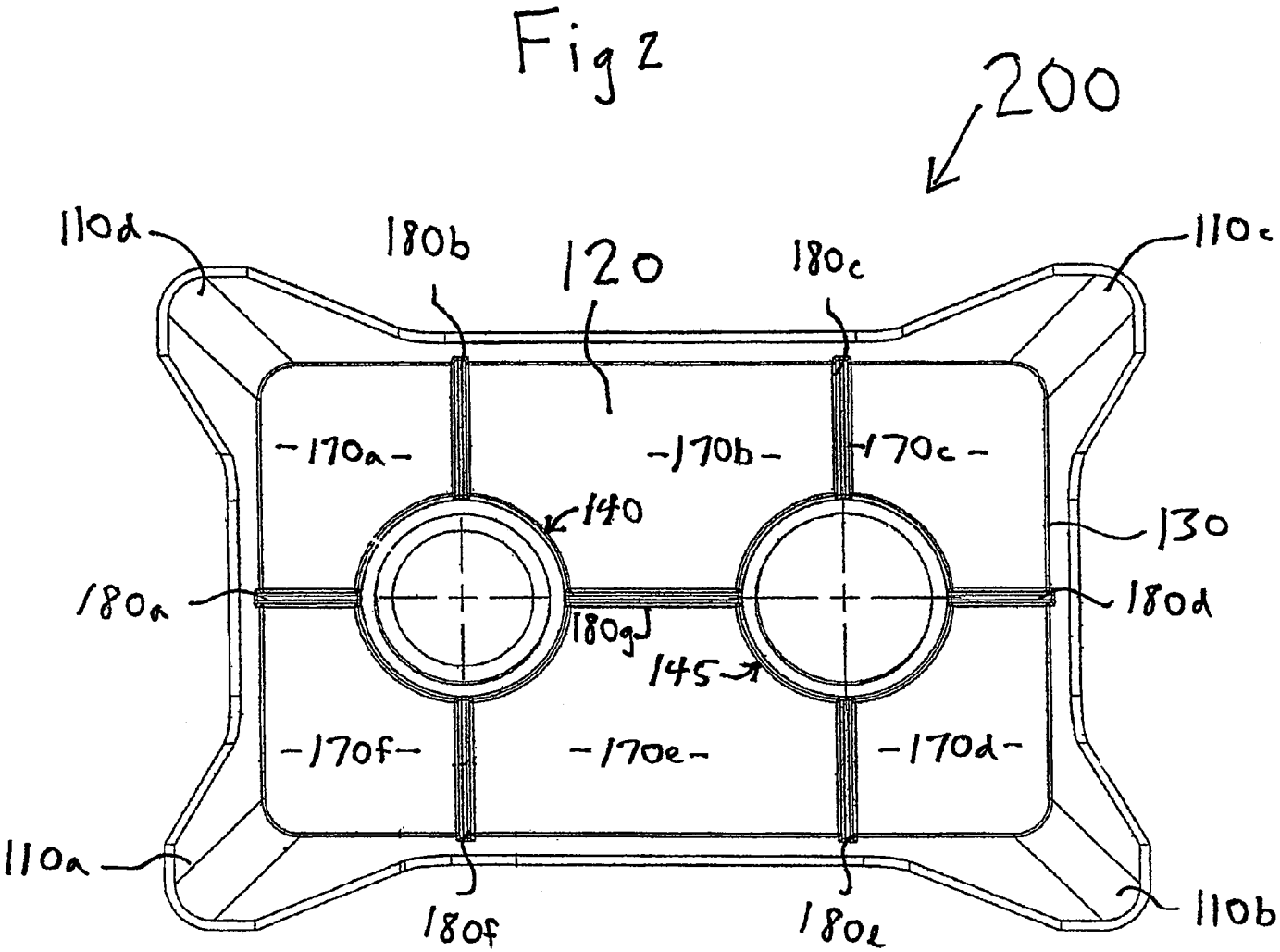
FIG. 2 is a top view of another embodiment of the invention.

Referring now to FIG. 2, depicted is a top view of another embodiment of the apparatus 100 of FIG. 1. As shown, apparatus 200 has the same leg design as above with four legs 110*a*-110*d* extending from the four corners of the apparatus 200. Moreover, apparatus 200 includes the same cavities design as in the embodiment of FIG. 1. However, unlike the aforementioned embodiment, the top surface 120 of apparatus 200 has been separated into a series of spill zones 170*a*-170*f* which are defined by a series of spill guards 180*a*-180*g*. In one embodiment, these spill guards 180*a*-180*g* are comprised of a raised portion vertically extending from the top surface 120 to some vertical height there above, such as for example the height of the lip 130. However, in another embodiment the spill guards 180*a*-180*g* may be higher or lower than the lip 130. Also, while apparatus 200 is shown as having six spill zones 170*a*-170*f*, it should equally be appreciated that there may be more or fewer spill zones 170*a*-170*f*.

In one embodiment, the spill guards 180*a*-180*g* function to compartmentalize any spillage which may occur across the top surface 120 from any containers which may have been coupled to the apparatus as described above. In this fashion spillage can be further contained. Moreover, use of the spill guards 180*a*-180*g* may prevent the liquid spilled from one attached container to mix with the liquid attached to a second attached container, thereby maintaining the usefulness of spilled liquids as described above.

Figure 3:
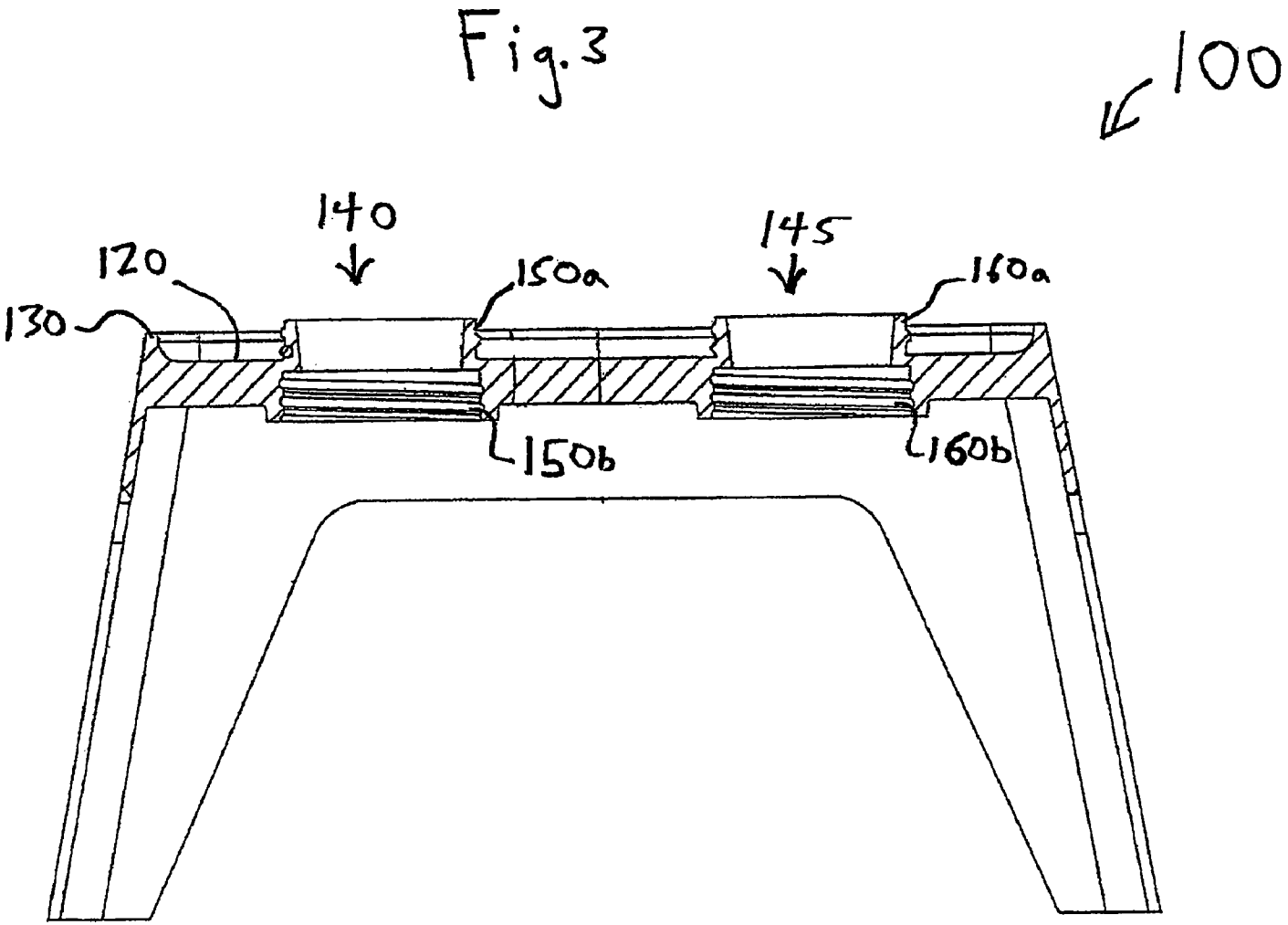
FIG. 3 is a cross sectional view of the embodiment of FIG. 1.

Referring now to FIG. 3, depicted is a cross sectional view of the apparatus 100 of FIG. 1. As shown, the lip 130 of apparatus 100 provides a raised barrier disposed along the periphery of the top surface 120 to capture any spillage which may occur. Cavities 140 and 145 are also shown as including both internal threads 150*b* and 160*b*, as well as external threads 150*a* and 160*a*. As described above, the internal threads 150*b* and 160*b* may be designed to accommodate the external threads of a container's opening. Similarly, external threads 150*a* and 160*a* may be designed to accommodate the internal threads of the container's lid or cap.

Figure 4:
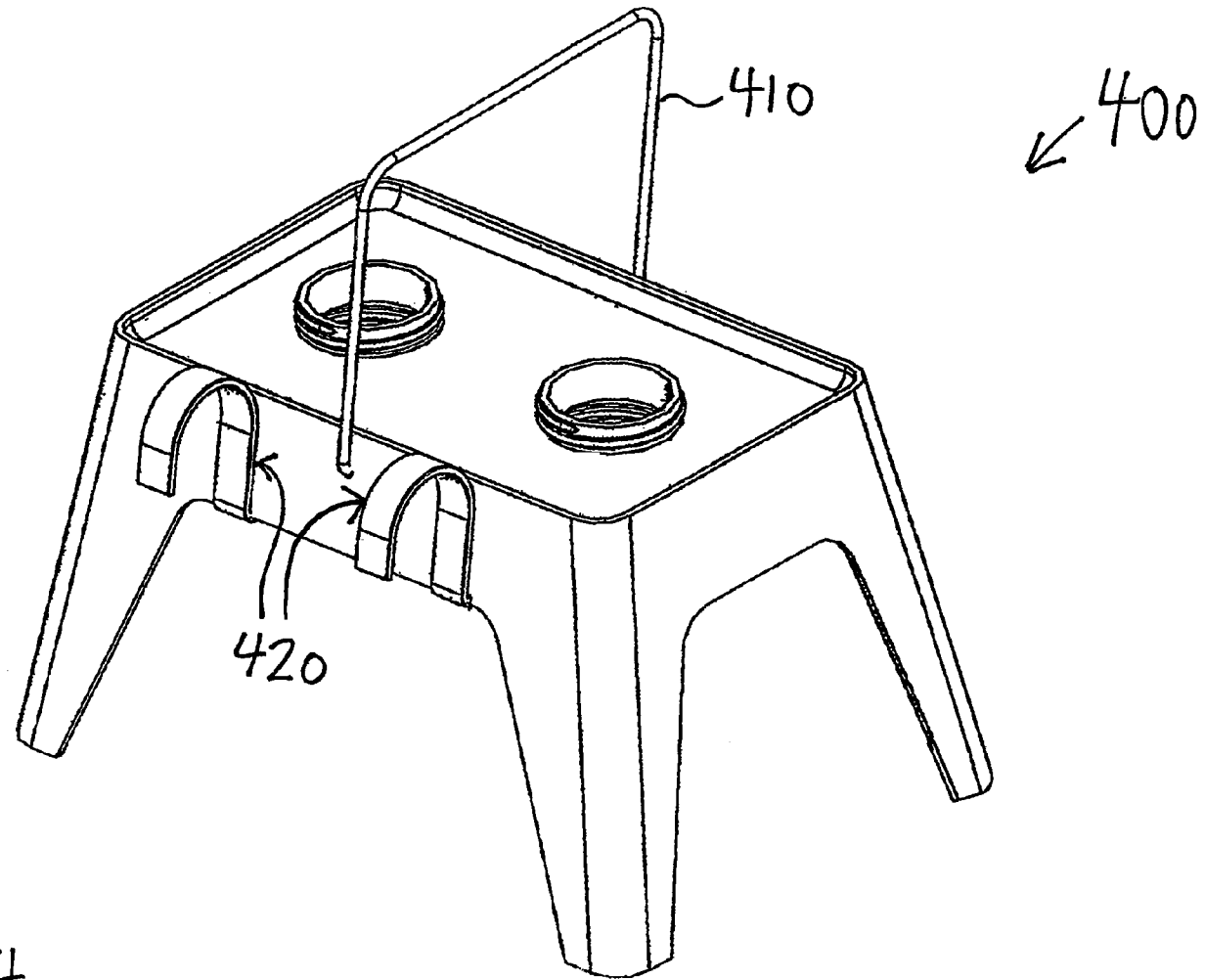
FIG. 4 is a perspective view of another embodiment of the invention.

Referring now to FIG. 4, depicted is another embodiment of the container carrying apparatus of FIG. 1 which incorporates a carrying handle. In this embodiment, container carrying apparatus 400 comprises a handle 410 which is hingeably attached to a first and second sides of the apparatus 400. That is, the carrying handle 410 is connected to the apparatus 400 via a swiveling connection in order to maintain the horizontal orientation of the apparatus 400 during transport, for example. It should further be appreciated that the handle 410 may be attached to any two opposite sides of the apparatus so as to maintain a horizontal orientation during transport.

Additionally, the apparatus 400 may be optionally configured with fasteners 420. In one embodiment, the fasteners 420 may function to hang or hook the apparatus 400 to a ladder, scaffolding or the like. In this fashion, the invention provides a spill-resistant carrying mechanism for two or more individual containers.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A spill-resistant carrying apparatus comprising:

a substantially planar surface having a top surface and a bottom surface, wherein the substantially planar surface is supported by a plurality of legs at a first height;

a lip disposed along a circumference of the top surface and extending to a second height that is greater than the first height; and a first and second cavity disposed along the substantially planar surface, wherein each of the first and second cavities include:

a set of internal threads extending into the bottom surface and configured to receive a threaded container opening, and a set of external threads extending from the top surface, adjacent to the set of internal threads, and configured to receive a threaded lid, wherein the substantially planar surface further includes a spill guard disposed on the top surface of the substantially planar surface, and oriented between the first cavity and the second cavity, said spill guard to extend from the top surface to a height greater than the first height.

2. The spill-resistant carrying apparatus of claim 1, wherein the set of internal threads have an insider diameter which corresponds to an outside diameter of the set of external threads.

3. The spill-resistant carrying apparatus of claim 1, wherein the set of external threads extends from the top surface of the substantially planar surface to a height greater than the first height.

4. The spill-resistant carrying apparatus of claim 1, wherein the spill guard extends from a first edge of the substantially planar surface to a second edge of the substantially planar surface.

5. The spill-resistant carrying apparatus of claim 4, wherein the spill guard is configured to divide the top surface into a plurality of spill zones.

6. The spill-resistant carrying apparatus of claim 1, wherein the spill guard height is substantially equal to the second height.

7. The spill-resistant carrying apparatus of claim 1, wherein the substantially planar surface further includes a plurality of spill guards disposed on the top surface and extending to a height greater than the first height, wherein the plurality of spill guards are configured to provide a plurality of compartmentalized spill zones along the top surface.

8. The spill-resistant carrying apparatus of claim 1, further comprising a handle hingeably attached to a first side and a second side of the apparatus.

9. An apparatus for containing liquid spills comprising:

a platform having a top surface and a bottom surface and being supported on a plurality of legs at a first height, wherein the platform includes a first and second cavity each having a set of female threads disposed into the bottom surface, and a set of male threads disposed into and extending from the top surface, said set of male threads being oriented substantially adjacent to the set of female threads; and a lip disposed along a periphery of the platform and extending to a second height greater than the first height, wherein the platform further includes a spill guard disposed on the top surface between the first cavity and the second cavity, and extending from the top surface to a height greater than the first height.

10. The apparatus of claim 9, wherein the set of female threads have an insider diameter which corresponds to an outside diameter of the set of male threads.

11. The apparatus of claim 9, wherein the set of male threads extends from the top surface of the substantially planar surface to a height greater than the first height.

12. The apparatus of claim 9, wherein the spill guard extends from a first edge of the platform to a second edge of the platform.

13. The apparatus of claim 12, wherein the spill guard is configured to divide the top surface into a plurality of spill zones.

14. The apparatus of claim 9, wherein the spill guard height is substantially equal to the second height.

15. The apparatus of claim 9, wherein the platform further includes a plurality of spill guards disposed on the top surface and extending to a height greater than the first height, wherein the plurality of spill guards are configured to provide a plurality of compartmentalized spill zones along the top surface.

16. The apparatus of claim 9, further comprising a handle hingeably attached to a first side and a second side of the apparatus.

* * * * *